US006495780B1

(12) United States Patent
Tucci et al.

(10) Patent No.: US 6,495,780 B1
(45) Date of Patent: Dec. 17, 2002

(54) WATERPROOF SEALED SWITCH WITH A SINGLE CONTACT AND METHOD FOR MANUFACTURING SAME

(75) Inventors: Michael Tucci, New York City, NY (US); Curt Delanoy, North Massapequa, NY (US)

(73) Assignee: Micro Contacts, Inc., Hicksville, NY (US)

( * ) Notice: Subject to any disclaimer, the term of this patent is extended or adjusted under 35 U.S.C. 154(b) by 0 days.

(21) Appl. No.: 09/948,324

(22) Filed: Sep. 7, 2001

(51) Int. Cl.[7] ..... H01H 9/02
(52) U.S. Cl. ..... 200/302.1; 200/535
(58) Field of Search ..... 200/16 R, 16 D, 200/520, 533, 534, 535, 302.1–302.3, 333, 341, 343

(56) References Cited

U.S. PATENT DOCUMENTS 5,181,603 A * 1/1993 Mori et al. ..... 200/302.1
5,828,016 A * 10/1998 Grannan et al. ..... 200/16 R
6,018,132 A * 1/2000 Chen ..... 200/406
6,087,606 A * 7/2000 Simpson ..... 200/535

* cited by examiner

*Primary Examiner*—Michael Friedhofer
(74) *Attorney, Agent, or Firm*—Jay H. Maioli

(57) ABSTRACT

A sealed switch has two switch contacts arranged inside a cavity formed in a molded switch body and the terminal connection for each switch contact are also arranged in respective cavities in the switch body. The switch contacts are sealed by a rigid sheet material that is adhered to the bottom of the switch body and a flexible sheet material that is clamped to the top of the switch body by a spring-like metal element that includes an actuator arm arranged adjacent the moveable one of the two switch contacts. Upon depression of the actuator arm, the flexible sheet material is deformed and a moving force is applied to the moveable switch contact to make a switch connection. The cavities housing the terminal connections are covered by a pierceable insulating material, so that connection pins on a circuit board pass through the insulating material and engage with the terminal connections during mounting of the sealed switch.

12 Claims, 4 Drawing Sheets

WATERPROOF SEALED SWITCH WITH A SINGLE CONTACT AND METHOD FOR MANUFACTURING SAME

BACKGROUND OF THE INVENTION

1. Field of the Invention

This invention relates generally to a waterproof sealed switch and, more particularly, to a waterproof sealed switch that has a single-pole contact surrounded by a waterproof sealed case and which has a construction intended for ease of manufacturing and insertion as a surface mount component.

2. Description of the Related Art

There are many demands for a waterproof sealed switch, however, such switches tend to be complex and costly both in their construction and in the manufacturing process required to assemble such switches.

Some waterproof sealed switches include a flexible covering over the switch elements and the switching actuation occurs by deformation of the flexible covering. In addition some waterproof sealed switches have multiple contacts positioned inside the waterproof covering, which necessitates a complicated assembly and contact insertion operation.

OBJECT AND SUMMARY OF THE INVENTION

Accordingly, it is an object of the present invention to improve upon U.S. Pat. No. 6,087,606 assigned to Micro Contacts Inc., invented by Leonard Simpson while an employee of Micro Contacts Inc., and to provide a waterproof sealed switch that incorporates a relatively simple, single switch contact and that can be easily and inexpensively manufactured in an environment that is sealed from external gaseous and liquid contaminants.

In accordance with one aspect of the present invention, the single contact and its actuator are arranged in an overlying relationship and top and bottom insulation sheets are arranged therearound and sealed with a heat-curing adhesive or ultrasonic welding to encapsulate the conductive switching members in a cavity. The top insulating sheet is composed of an elastomeric membrane material which is perimeter sealed to a structural body and mechanically captured by spring action provided by a formed metal cover that also provides a protruding actuating dome used to activate the switching mechanism. The electrical terminations for connection to the active switching mechanism may be located on the bottom, top, or sides of the case and may incorporate, among other mechanical fastening techniques, an internal female terminal for solderless pin connection.

According to another aspect of the present invention, at the location where the terminals would typically exit from the mounting surface of the case, the terminals are instead encapsulated in a gasket covered cavity. This permits an intrusive bayonet or bandoliered or snap-in 0.025" (635 mm) square post header to penetrate the cavity and make contact with the female terminal. This provides a penetration process for termination connections to, for example, a printed circuit board or similar manufacturing processes.

According to another aspect of the present invention, the switch can be manufactured by forming the contact elements in metal strip form and then operating on the metal strip to place the switch contacts in the proper spatial relationship prior to arranging the top and bottom of the casing therearound. Subsequently, a shearing operation is performed that separates the electrical terminations for each switch from the strips.

The above and other objects, features, and advantages of the present invention will become apparent from the following detailed description of illustrative embodiments thereof to be read in conjunction with the accompanying drawings.

DETAILED DESCRIPTION OF THE PREFERRED EMBODIMENTS

Figure 1:
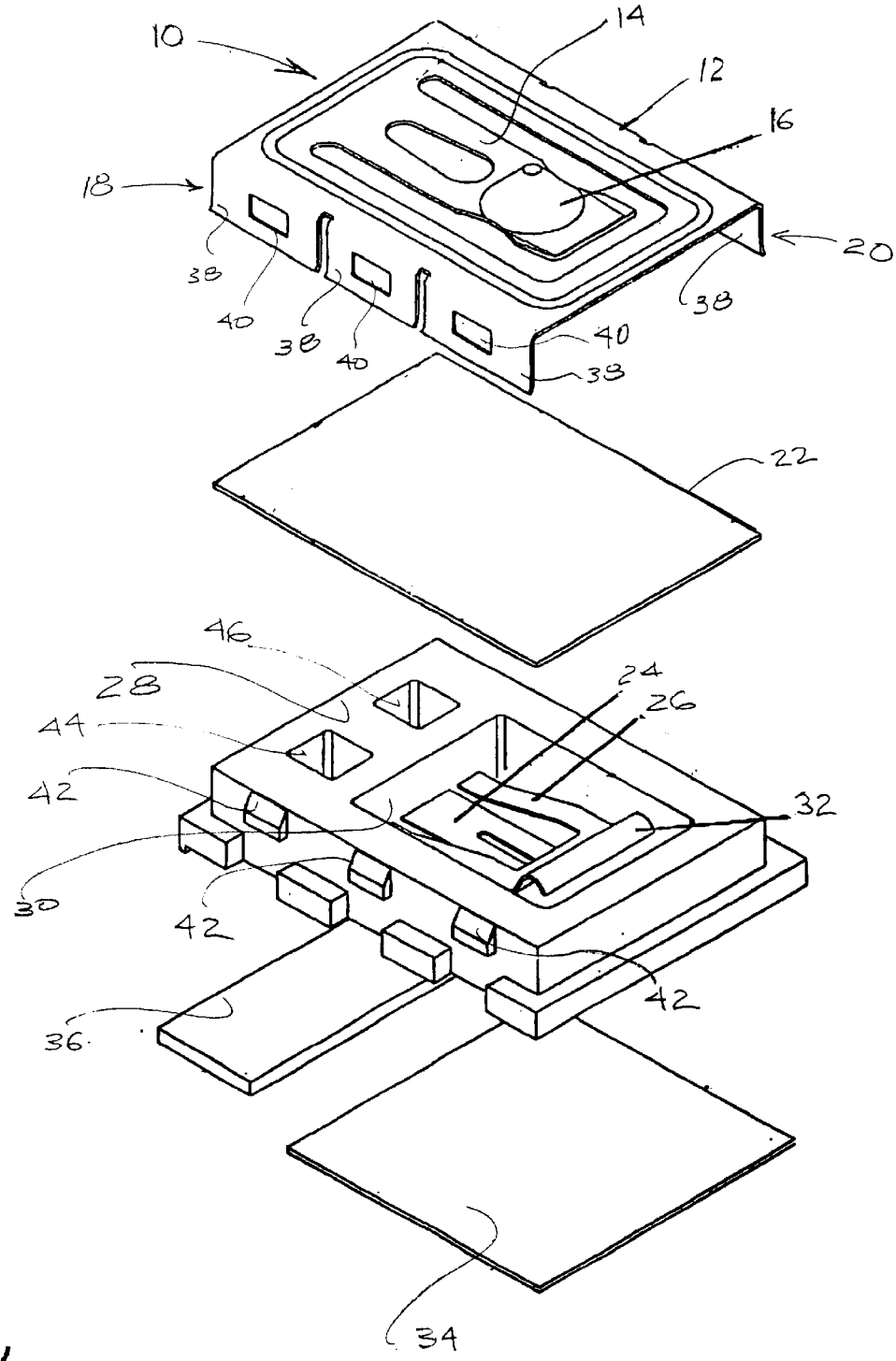
FIG. 1 is an exploded view of the switch assembly according to an embodiment of the present invention.

In FIG. 1, which is an exploded view of the inventive waterproof sealed switch, an external actuator element 10 is formed of a metal element enclosure 12 having spring properties with a free cantilevered beam 14 formed with a domed section 16 protruding from the free end of the cantilevered beam 14. The sides 18, 20 of this metal element enclosure 12 provide rigid top and side support for the assembled switch A thin insulating sheet 22 of elastomeric material, to which may be applied a very thin layer of heat curable adhesive material, is used to seal the actual switch contacts. Alternatively, an ultrasonic welding process could be employed in place of the adhesive material. The metal electrical contacts 24, 26 forming the switch are arranged inside a plastic switch body 28 and, more specifically, reside in a hollow cavity portion 30 of the switch body 28. A crossbar 32 is part of electrical contact 26 and is actuated by depressing dome 16, which actuation then closes or completes the circuit by electrically and mechanically connecting electrical contacts 24 and 26 together. A rigid sheet 34 of insulating material, such as plastic, provides the structural and enclosure means for the bottom of the assembled switch by being fastened to the bottom of the switch body 28. Another sheet of insulating material 36, such as tape or penetratable plastic capable of allowing puncturing without fracture, is attached to the bottom of the switch body 28, so that a bayonet-type mode of termination can be used during subsequent assembly operations. Sheet 36 is used to cover the two small terminal cavity areas that contain the switch terminals. The electrical terminations for the switch may be placed at the bottom, side or top of the switch housing.

The metal enclosure element 12 has the respective sides 18 and 20 each formed of three flat arms, shown typically at 38. Each flat arm 38 has an aperture 40 formed therein. The apertures 30 receive respective tabs, shown typically at 42, formed on the sides of the switch body 28. Because the metal enclosure element 12 has spring properties, when the switch is assembled the flat aims 38 deform outwardly so that the tabs 42 snap into respective apertures 40.

The electrical terminals, not seen in FIG. 1, for electrical contacts 24, 26 reside in cavities 44, 46 and in this embodiment the electrical terminals are accessed by puncturing the sheet of insulating material 36.

Figure 2:
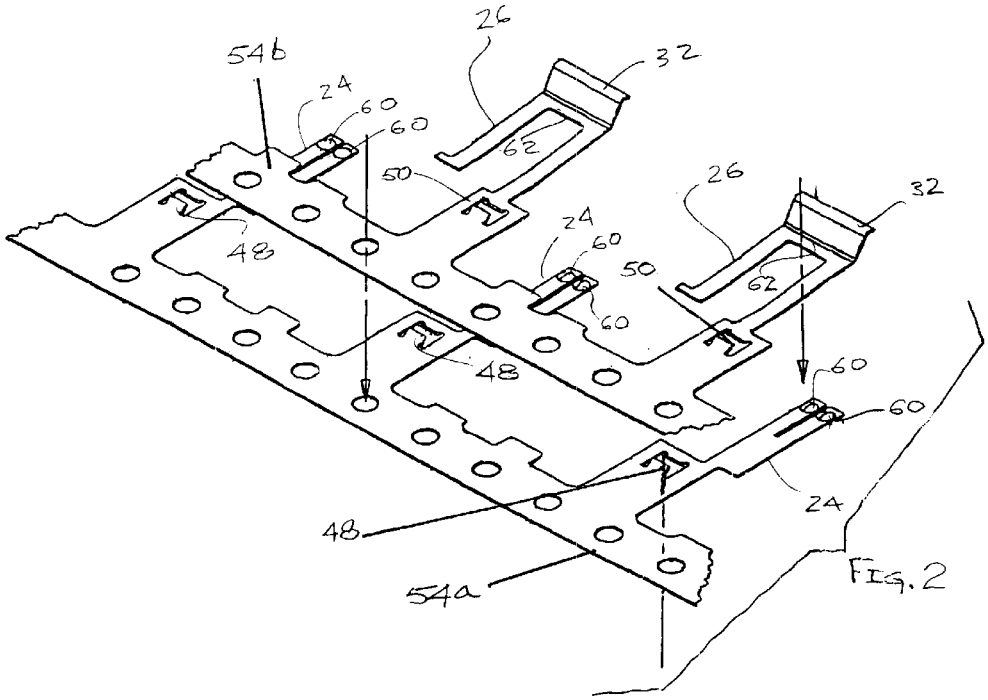
FIG. 2 represents the contact elements of the switch of FIG. 1 during a step in the manufacturing operation.

FIG. 2 shows the switch elements in a free state before molding or assembly as they are manufactured connected to respective common continuous metallic strips, and FIG. 2 shows their spatial and sequential relationship to each other in the preassembly process. Female electrical terminals 48 and 50 of contacts 24 and 26, respectively, are used to mechanically and securely capture a solderless pin that penetrates from the underside of the switch to provide electrical continuity to an external circuit. These terminals 48 and 50 respectively reside in the cavities 44 and 46 shown in FIG. 1.

More specifically, as shown in FIG. 2, continuous metal strips 54*a* and 54*b* respectively have the electrical contacts 24 and 26 formed therealong, each with its respective female electrical terminal 48 and 50. The continuous metal strips 54*a*, 54*b* have has sproket holes, shown generally at 56, formed therealong. The fixed electrical contact 24, that is, the one of the pair that is not actuated by pushing on the dome-shaped element 16 of FIG. 1, is formed with bifurcated arms each having a contact button 60 at an outer end thereof.

The formed button-type metal contacts 60 are engaged to the underside of contact bar 62 when the crossbar 32 is depressed by exerting a force on domed section 16 shown in FIG. 1, thereby completing the switch circuit.

The strips of electrical contacts shown in FIG. 2 can be formed by stamping operations or the like, as known in the art.

Figure 3:
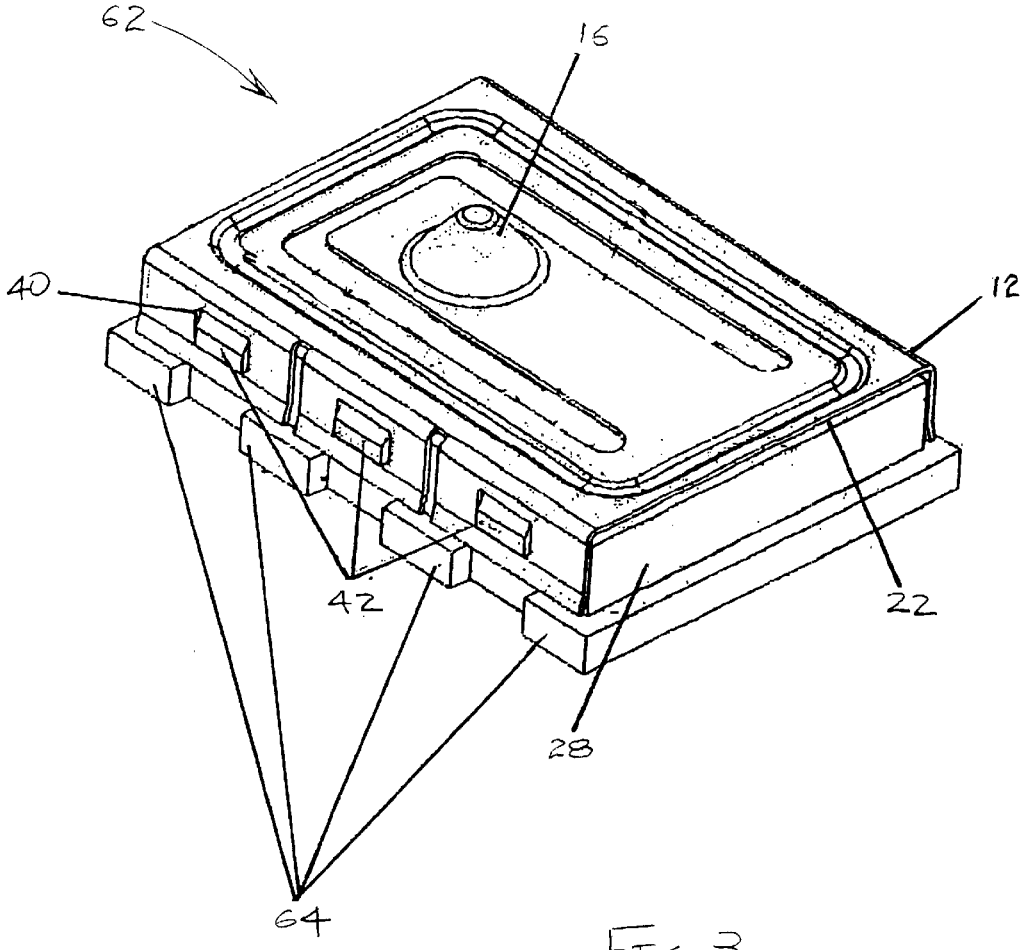
FIG. 3 is a perspective view of an assembled waterproof switch according to an embodiment of the present invention.

FIG. 3 is a perspective view of a waterproof sealed switch 62 according to an embodiment of the present invention showing the spring-type metal enclosure element 12 surrounding the insulated plastic body 28 that houses the switching elements 22 and 24 in the recessed cavity 30, not seen in FIG. 3, and which are actuated by depressing domed section 16.

The spring properties and precise dimensioning and positioning of the metal enclosure element 12 serve to capture the elastomeric membrane gasket 22 which is perimeter sealed and restrained by the solid insulated plastic body 28, when the side tabs 42 snap and interlock into the rectangular apertures 40 of the flat arms 38 of the metal enclosure element 12. Pads, shown typically at 64, at the bottom of insulated plastic body 28 serve as mounting bases for capture during subsequent assembly operations and provide stability for the component on the circuit board or the like.

Figure 4:
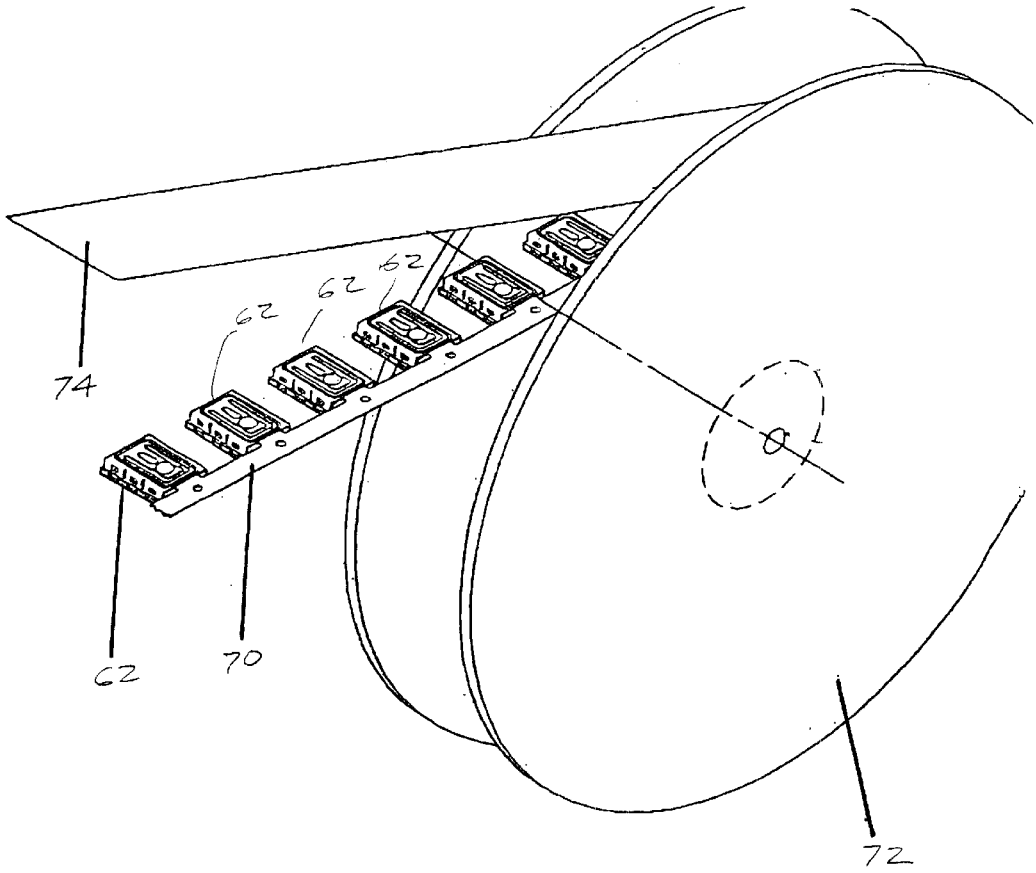
FIG. 4 shows a number of completed switches produced after the molding, stamping and automated assembly process transferred to a reel for easy transport and post-component assembly processing.

FIG. 4 shows the completed waterproof switch assemblies 62 retained on a continuous metal strip 70 and rolled onto a reel 72 for automated discharge at subsequent assembly operations. A paper interleaf 74 separates the successive layers of waterproof switches 62 placed on each reel 72.

The manner in which the roll of completed waterproof switch assemblies shown in FIG. 4 is obtained will now be explained with reference to FIGS. 2 and 3. As shown in FIG. 2, the contacts 24, 26 are produced on strips 54*a* and 54*b*, that are arranged so that the contact surfaces are in the proper functional position for molding and forming the switch body 28. The switch bodies 28 are continuously molded over the contacts 24, 26 that have been located in the proper position and the molded switch bodies are carried out of the molding station using the carrier strips 54*a* and 54*b*. The flexible insulating sheet 22 is then arranged over the upper surface of the molded switch body 28 and clamped using the spring metal element 12 having the actuation element 16 formed therein. The spring metal elements 12 are fed into this operation as part of a continuous strip, which is shown at 70 in FIG. 4. The sub-assembled switches are then cut free from the carrier, sub-strips 54*a* and 54*b*, used during the continuous molding operation and are carried by strip 70. The bottom of the switch body 28 is then sealed off by adhering the insulated sheets 34, 36 to the bottom surface of the switch body 28. The assembled switches still attached to strip 70 can then be wound on reel 72.

It is understood, of course, that the foregoing is presented by way of example only and that many alternatives and modifications could be made by the ordinarily skilled artisan, while still practicing the present invention.

What is claimed is:

1. A switch assembly comprising:

a body;

a first metal contact arranged in a cavity formed in the body and having a contact end and a connection end for making an electrical connection thereto arranged within a first recess formed in the body;

a second metal contact arranged in the cavity adjacent the first metal contact and having a connection end for making an electrical connection thereto arranged within a second recess formed in the body, a contact portion spaced apart from said contact end of said first metal contact, and an actuation portion;

sealing means for sealing said first metal contact and said second metal contact in said cavity of said body and for sealing said first and second recesses formed in the body;

a spring metal enclosure element for clamping a portion of said sealing means against said body and having a free end of a cantilevered arm arranged adjacent said actuation portion of said second metal contact with said sealing means arranged therebetween, whereby upon depressing said free end of said cantilevered arm said contact portion of said second metal contact is moved into mechanical contact with said contact end of said first metal contact.

2. The switch assembly according to claim 1 wherein said free end of said cantilevered arm includes a domed portion for receiving a pressing force.

3. The switch assembly according to claim 1, wherein said spring metal enclosure element has a plurality of apertures formed in side surfaces thereof and said body has a respective plurality of tabs formed in side surfaces thereof, whereby said plurality of tabs are respectively engaged with said plurality of apertures with said portion of said sealing means clamped therebetween.

4. The switch assembly according to claim 1, wherein said sealing means sealing said first and second recesses is formed of piercable material, so that contact posts can penetrate therethrough and contact the connection end of said first metal contact and the connection end of said second metal contact respectively residing in said first recess and said second recess.

5. The switch assembly according to claim 1, wherein said second metal contact is formed with first and second arms arranged adjacent respective sides of said first metal contact and connected by a contact bar forming said contact portion, wherein said connection end is formed at a free end of said first arm.

6. A method for making a sealed switch assembly, comprising the steps of:

forming a plurality of first metal contact elements and second metal contact elements on respective continuous metal strips;

arranging the first metal contact elements and the second metal contact elements into respective predetermined functional positions;

molding a switch body around each pair of the arranged first and second contact elements attached to the continuous metal strips, so that contact ends of the first and second metal contact elements reside in a first cavity of the molded switch body and connection ends of the first and second metal contact elements reside in respective second and third cavities of the molded switch body;

arranging a first flexible insulating sheet over an upper surface of the molded switch body;

clamping the flexible insulating sheet against the molded switch body with a spring metal element having an actuation element formed therein and attached to on a continuous carrier strip, thereby sealing top areas of the first cavity and the second and third cavities;

adhering a second flexible insulating sheet to a portion of a bottom surface of the molded switch body, thereby sealing a bottom area of the first cavity; and adhering a piercable insulating sheet to a remaining portion of the bottom surface of the molded switch body, thereby sealing a bottom area of the second and third cavities.

7. The method according to claim 6 comprising the further step of coiling the continuous carrier strip having the molded switch bodies attached thereto on a reel.

8. A sealed switch assembly comprising a first metal contact element having contact buttons formed at a bifurcated end thereof and a first female connection terminal formed at an opposite end thereof;

a second metal contact element formed of first and second arms connected at respective ends by a contact bar integrally formed with a crossbar, wherein a second female connection terminal is formed at an opposite end of the first arm;

a molded plastic switch body surrounding said first and second metal contact elements and formed having a first open cavity, wherein said first and second arms of said second metal contact element are arranged adjacent respective sides of the bifurcated end of said first metal contact element in said first open cavity, said first female connection terminal is arranged in a second open cavity, and said second female connection terminal is arranged in a third open cavity;

sealing means formed of flexible insulating material for sealing top and bottom open areas of said first cavity formed in said molded switch body;

a pierceable insulating element adhered to a bottom surface of said molded plastic switch body for sealing bottom open areas of said second and third cavities formed in said molded plastic switch body; and a metal enclosure element for clamping a portion of said flexible insulating material of said sealing means to said switch body and having a cantilevered arm with an actuating end arranged proximate the top open area of said first cavity.

9. The sealed switch assembly according to claim 8, wherein said actuating end of said cantilevered arm of said metal enclosure element is formed as a dome.

10. The sealed switch assembly according to claim 8, wherein said actuating end of said cantilevered arm of said metal enclosure element has a raised configuration.

11. The sealed switch assembly according to claim 8, wherein said metal enclosure element is formed of metal having spring properties and has a plurality of openings formed in side surfaces thereof and said molded plastic switch body has a respective plurality of tabs formed in side surfaces thereof, whereby said plurality of tabs are respectively engaged in said plurality of apertures with said flexible insulating material of said sealing means captured therebetween.

12. The sealed switch assembly according to claim 8, wherein said molded switch body includes a plurality of mounting tabs formed at bottom edges of side surfaces thereof.

* * * * *